United States Patent [19]

Davies et al.

[11] 4,090,912

[45] May 23, 1978

[54] WRAPPING MACHINES

[75] Inventors: Robert William Davies; Frederick Pratt; Michael Gordon Pearse, all of London, England

[73] Assignee: Molins Limited, London, England

[21] Appl. No.: 726,097

[22] Filed: Sep. 24, 1976

[30] Foreign Application Priority Data

Oct. 1, 1975 United Kingdom ..... 40116/75

[51] Int. Cl.[2] ..... B65H 69/06; B31F 5/00

[52] U.S. Cl. ..... 156/502; 83/324; 83/571

[58] Field of Search ..... 83/324, 571, 572; 156/502

[56] References Cited

U.S. PATENT DOCUMENTS

| | | | |
|---|---|---|---|
| 3,308,701 | 3/1967 | Frohling | 83/324 |
| 3,791,244 | 2/1974 | Dofek | 83/324 X |

*Primary Examiner*—J. M. Meister

*Attorney, Agent, or Firm*—John C. Smith, Jr.

[57] ABSTRACT

A wrapping machine for cigarette packets has a cyclic drive for cutting the wrappers and feeding them towards cigarette bundles to be wrapped. The drive, which may take the form of a cyclic gearbox having an eccentric gear, passes through a clutch which can be disengaged at the minimum drive speed, for example when a bundle is missing or the wrapper web is being spliced.

7 Claims, 13 Drawing Figures

303
302
301
310
311
312
313
314
320A
316
317
315
335
338
336
337
337A
320
318
329
341
340
331
332
A
321
330
339
327
328
326
319A
P1
P3
342
P4
344
323
322
P2
323
319B
324
325
320B
350A
B
350B
P5
352A
351A
343
352B
351B
353
354A
356
355
357
354

WRAPPING MACHINES

This invention relates to wrapping machines, more especially machines for wrapping cigarette packets.

According to one aspect of the invention there is provided apparatus for wrapping articles, such as cigarette packets, comprising means for cutting a web of wrapping material to form individual wrappers, means for feeding the wrappers successively towards articles to be wrapped, drive means to drive the cutting and feeding means at a cyclically varying speed, and clutch means to disengage the drive means when no wrappers are to be fed, said clutch means being disengageable and re-engageable at the minimum speed of the drive means.

The drive means may include a cyclic gearbox of the type having an eccentric gear.

The clutch means may comprise a driving member connected to the cyclic drive means, a driven member a driving surface on one of the members, a pawl pivotally mounted on the other member and biased to engage the driving surface, and means to arrest the driven member at the angular position at which the driven member is rotating at minimum speed, the driving surface and the pawl being so shaped and disposed that the pawl is cammed away from the driving surface upon such arresting of the driven member. Preferably the driving surface has a recess in which the pawl is received so that the relative positions of the driving member and the driven member are always the same whenever the clutch means is engaged.

The means to arrest the driven member may be an abutment member secured to the driven member, and an element movable into the path of the abutment member to arrest the driven member.

A splicing mechanism may be provided upstream of the cutting means to splice a new web to an exhausted web, said splicing mechanism being operably connected to said clutch means so that the feed of the wrappers is interrupted during a splicing operation.

The splicing mechanism may comprise means to form an indentation in the portion of the web which is spliced, and a splice detector to detect said indentation and to signal to a rejection mechanism that one or more articles are faulty wrapped in a spliced portion of the web.

A second aspect of the invention provides apparatus for wrapping articles, such as cigarette packets, comprising in indexable drum having pockets each to receive a partly wrapped article, means for performing wrapping operations on each article while in a pocket, and conveying means for extracting the articles from the pockets and for moving them in steps along a substantially rectlinear path past means for performing further wrapping operations.

Said means for performing further wrapping operations may include means for applying solvent to the flaps of a wrapper to be folded, comprising a fixed solvent wick for each flap disposed along said path, and means to bring each flap into contact with a wick while the article to be wrapped is stationary.

A wrapping machine in accordance with the invention will now be described with reference to the accompanying drawings in which.

Figure 1:
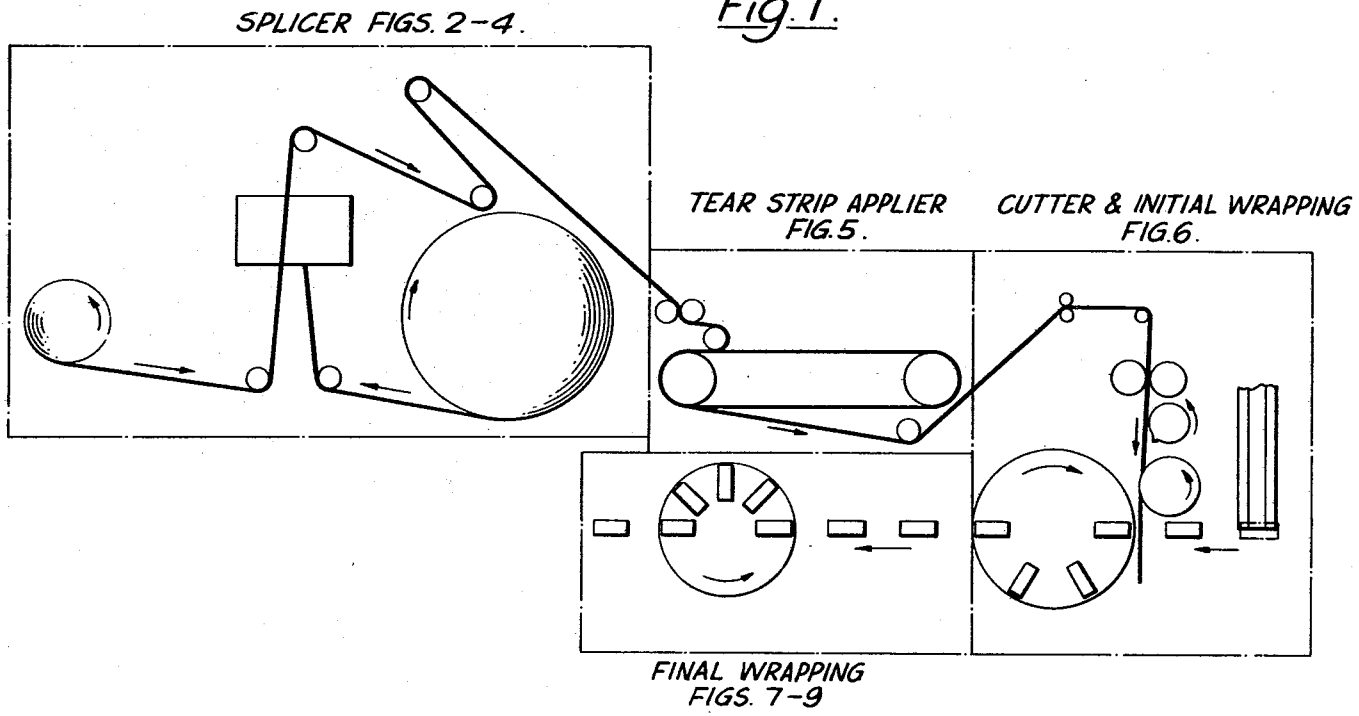
FIG. 1 is a schematic front view of the machine showing the various main units.

The whole wrapping machine is shown schematically in FIG. 1, and to the left thereof is shown the first main unit of the machine, the splicing mechanism, which will now be described.

Splicer

Figure 2:
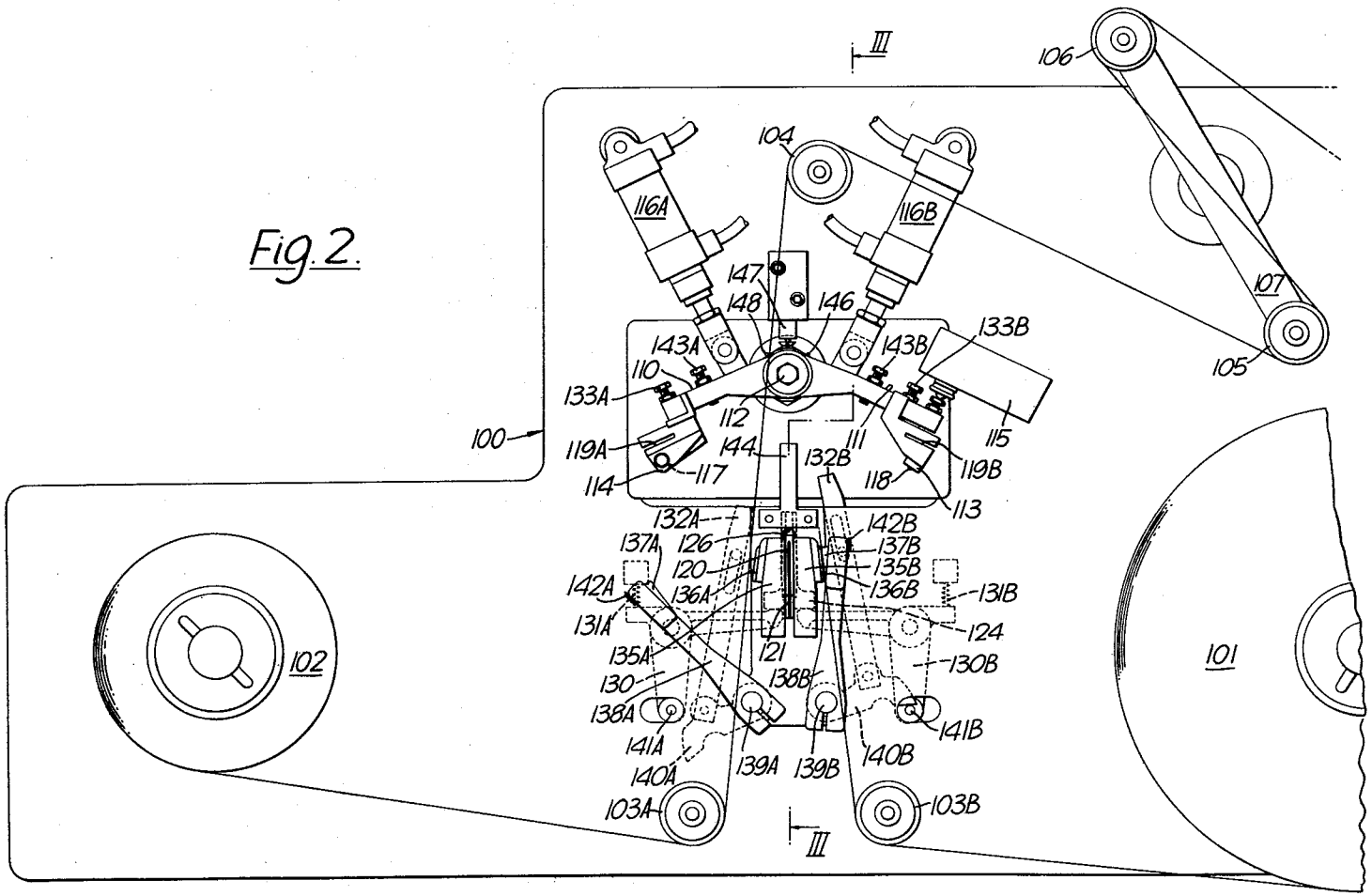
FIG. 2 is a front view of the splicing mechanism.
Figure 3:
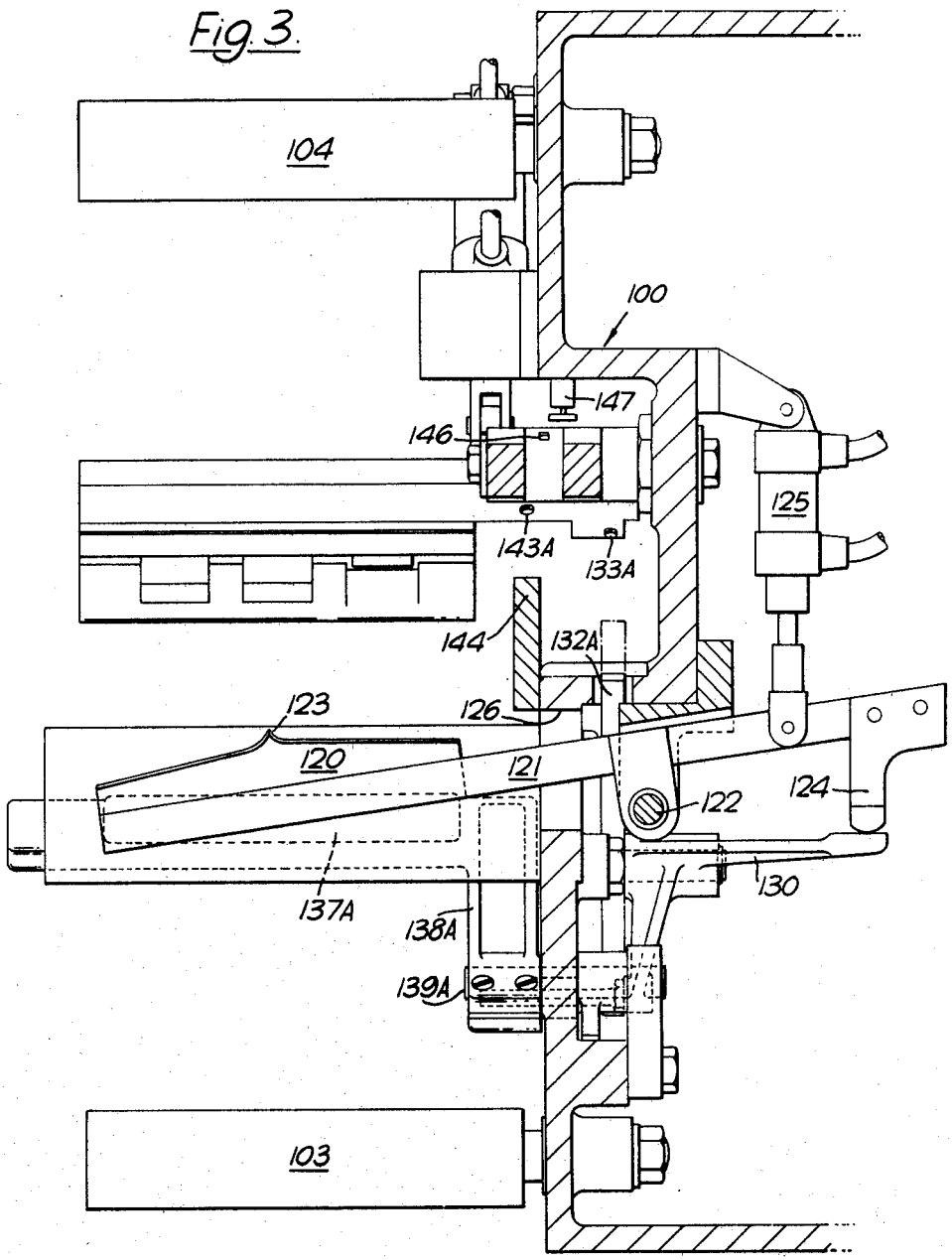
FIG. 3 is a sectional view taken on the line III—III of FIG. 2 but drawn to a larger scale.
Figure 4:
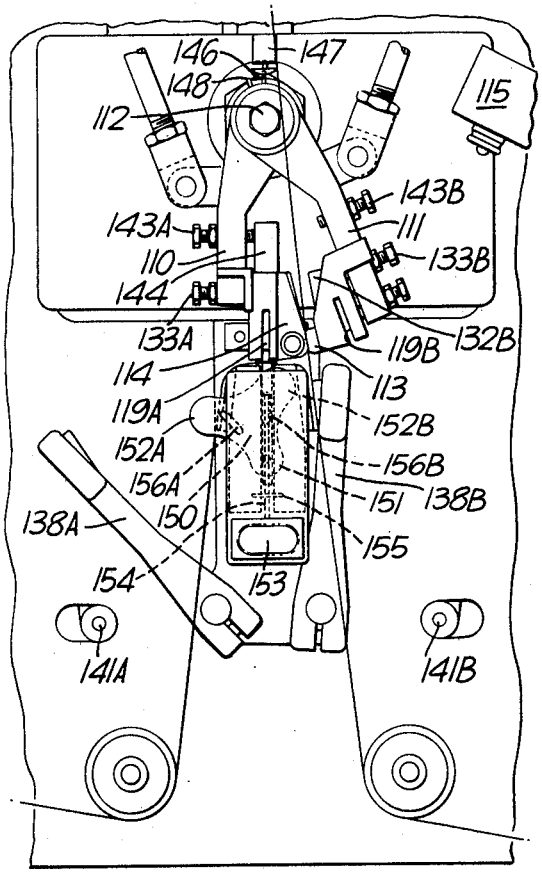
FIG. 4 is a view similar to the central part of FIG. 2, but showing a splice being formed.

The splicing mechanism, shown in detail in FIGS. 2 to 4, is mounted on a substantially vertical frame indicated generally by the reference numeral 100. As shown, a new reel 101 of wrapping web (which may be made from a film of cellulose, such as Cellophane (R.T.M.), or of polypropylene) is rotatably mounted on the right of the frame 100, as viewed in FIG. 2, and a running reel 102 (shown nearly exhausted) is rotatably mounted on the left of the frame. The web from the running reel 102 passes around pulleys 103A and 104, and then forms two loops around pulleys 105 and 106. The latter pulleys are mounted at opposite ends of an arm 107 which is pivoted at its centre and spring biased anticlockwise so that the pulleys tend to move in a direction to lengthen the web path.

A brake (not shown) is associated with each reel 101 and 102, and each brake is cam actuated by pivotal movement of the arm 107.

The feed of web to the wrapping machine to be described is cyclic, and the operation of the arm 107 and brakes is as follows:

At the period of the cycle when the speed of the web being fed to the wrapping machine is increasing, the arm 107 rotates clockwise against the spring bias, reducing the length of the web path. This also causes the brakes on the reels to be fully released so that the reel 102 is accelerated against its own inertia. On the other hand when the web is being fed at a decreasing speed the spring bias pivots the arm 107 anticlockwise, which causes the reel 102 (and also reel 101) to be braked, resulting in the speed of the reel 102 being slightly reduced, and the web tension being maintained.

The arm 107 thus moves between two extreme positions, smoothing the flow of web so that the speed of the web coming off the reel 102 (or reel 101, when operational) only fluctuates slightly. The degree of braking on the reels is adjustable, so that the mean tension in the web can be varied.

As several of the parts to be described below are similar or opposite-handed pairs, such parts to the left (as viewed in FIGS. 2 and 4) carry the suffix A, and those to the right suffix B.

A pair of splicing arms 110 and 111 are pivotally mounted about a common axis 112. Arm 111 carries an electrically heated splicing iron 113, while arm 110 carries an anvil 114.

The anvil 114 is formed with a depression 117 which is of a shape complementary to a projection 118 formed on the splicing iron 113. The function of these is to produce an indentation in the spliced portion of the web, which can be sensed more reliably than the actual splice by a detector (not shown) before the web is cut into wrapper lengths by apparatus to be described below. A signal produced by the detector enables packets wrapped with wrappers having a splice on them to be subsequently rejected at a rejection unit (not shown) for wrapped packets.

Arms 110 and 111 are actuated respectively by pneumatic rams 116A and 116B to move them from the retracted position shown in FIG. 2 to a splicing position shown in FIG. 4.

A switch 115 is arranged to be operated when the arm 111 is moved away from the retracted position shown in FIG. 2. While the switch 115 is operational (as shown in the position of FIG. 4) the feed of the web to the wrapping machine is arrested, as will be described later.

A slot 119A is positioned to one side of the anvil 114, and a similar slot 119B is positioned at the other side of the splicing iron 113.

As best seen in the sectional view of FIG. 3, a splicing knife 120 is carried at one end of an arm 121, the arm passing through an opening 126 in the frame 100 and being pivotable about a shaft 122. The knife 120 is pointed at the middle 123 of its cutting edge, which is of shallow V form, to enable it to pierce a web and thereafter to cut progressively outward towards both edges of the web. With the splicing arms in the position shown in FIG. 4 the knife in operation enters the slot 119A in the anvil 114.

The other end of the arm 121 carries a pusher member 124 and is actuable by a pneumatic ram 125. The pusher member 124 engages the ends of two oppositely disposed bell-cranks 130A and 130B. Compression springs 131A and 131B bias the ends of the respective bell-cranks against the member 124. The other ends of the bell-cranks carry cylindrical projections 141A and 141B, which extend through arcuate slots in the frame 100.

Secured to the frame at each side of the knife 120 are members 135A and 135B having clamping surfaces 136A and 136B against which the respective new web can be clamped by cooperating pads 137A and 137B at the ends of arms 138A and 138B. These arms are secured on shafts 139A and 139B, and spring biassed away from the respective clamping surface. A lever 140A and 140B is also secured on each shaft 139A and 139B, and in the position shown in FIG. 2 the end of the lever 140B latches over the projection 141B and holds the pad 137B in clamping engagement with the surface 136B. If desired the projection 141B (or 141A when lever 140A is latched) can be moved towards the right by hand to unlatch the lever 140B and so release arm 138B.

Splicer Operation

The operation of the splicing mechanism will now be described:

The new web from reel 101 is passed around the pulley 103B, and placed against the surface 136B. The arm 138B is next pivoted by hand to bring the pad 137B towards the surface 136B, thus clamping the new web.

Along the outside of each arm 138A and 138B is a serrated knife 142A and 142B respectively. With the arm 138B in the position shown, the end of the new web can be pulled against the knife 142B to cut the end of the web to the desired length for splicing.

When the running reel 102 is exhausted, as sensed by a feeler arm (not shown) bearing radially against the reel, the feed of web to the wrapping machine is stopped by a clutch arrangement to be described below. When the now exhausted reel 102 has been brought to rest by its brake, a ram (not shown) is operated to override the brake actuation and so allow some slack in the web. The rams 116A and 116B are then actuated to pivot the arms 110 and 111 towards each other, and so bring the end of the new web into splicing engagement with the old web between the anvil 114 and the heated splicing iron 113.

An adjustment screw 143A on the arm 110 bears against a stop 144 on the frame 100 to arrest the arm 110 at the position shown in FIG. 4. Each lever 140A and 140B has pivotally connected to it a stop bar 132A and 132B respectively. An adjustable screw 133B on arm 111 bears against the stop bar 132B (which is raised because arm 138B is in clamping position) and brings the arm 111 to rest at the splicing position shown in FIG. 4.

As the formation of the splice commences, the ram 125 is actuated to pivot the arm 121, thus bringing the knife 120 into the slot 119A to cut the upstream end of the exhausted web. Pivoting of the arm 121 also moves bell-crank 130B anticlockwise which frees the lever 140B, allowing the arm 138B to move outwards to release the new web.

In order to ensure that the arms 110 and 111 are in the correct splicing position shown in FIG. 4, so that knife 120 will be free to enter into slot 119A, the arm 110 carries a projection 146 near its pivotal axis 112, which closes a switch 147 when the arm 110 is in the splicing position. The switch 147 is connected to the control circuit (not shown) of the ram 125, so that the ram can only be actuated when the switch is closed. Similarly, when a splice is to be formed to the left of the knife 120 (i.e. when the reel 101 has become exhausted and the reel 102 has been replaced by a new reel, as further described below), a projection 148 on arm 111 closes the switch 147, thus ensuring that the knife 120 is free to enter into slot 119B.

The duration of the splice i.e. the period of time during which the webs are clamped between the anvil 114 and the heated splicing iron 113, is timed by pneumatic means, and is manually variable. During this period the wrapping machine allows packets to be passed through it without being wrapped. Switch 115 is coupled through a logic circuit to a rejection unit (not shown), so that all packets which pass through the machine while arm 111 is in the operative splicing position, i.e. out of contact with the switch 115, will be rejected.

When the splice has been formed, the rams 116A and 116B return the arms 110 and 111 to the retracted position shown in FIG. 2. The switch 115 being rendered inoperative, the cyclic feed of the web (now from the new reel 101) will then recommence.

The reel 102 will then be replaced by another new reel and the web from this reel clamped into position as previously described, this time by pad 137A on arm 138A. When the reel 101 has become exhausted, a splice will automatically be made as before. However, this time the stop bar 132B will have been lowered and the stop bar 132A raised, so that a screw 133A on arm 110 brings that arm to rest to the left of the knife 120, while a screw 143B on arm 111 bears against the stop 144 to bring the splicing iron 113 to rest also towards the left of the knife, so that the knife in operation will now enter into the slot 119B.

In the event that it is desired to make a splice before a running reel is exhausted, this may be done manually (instead of being initiated by the feeler arm of the reel) by a device shown only in FIG. 4: for the sake of clarity the device has been omitted from FIGS. 2 and 3. A T-shaped lever 150 is pivotally mounted at 151 in front of the members 135A and 135B. The lever has two lobes 152A and 152B, which are engageable by the arms 138A or 138B to move lever 150 respectively from a normally central position to a right-hand or a left-hand position. Below the lever 150 is a 153, the actuation of which initiates the splicing sequence described above. The switch 153 had a rod 154 connected to it, which is pivotable about a fulcrum 155 and which passed behind the lever 150. When the lever 150 is in the left-hand position shown in FIG. 4, the top of the rod 154 can pass through an aperture 156B in the lever 150, allowing the switch 153 to be depressed. Similarly, if the lever 150 is in the right-hand position, the top of the rod 154 can pass through an aperture 156A and allow the switch 153 to be depressed.

The width of the lever 150 across the lobes 152A and 152B is such that only one of the arms 138A or 138B can be latched on at any time. Since the lever 150 is biassed towards a central position in which the apertures 156A and 156B are on opposite sides of the rod 154, it is therefore only possible to depress the switch 153 if one of the arms 138A or 138B is in the operational position, when one of the apertures 156A or 156B will be in line with the top of the rod 154.

Tear-Strip Applier

Figure 5:
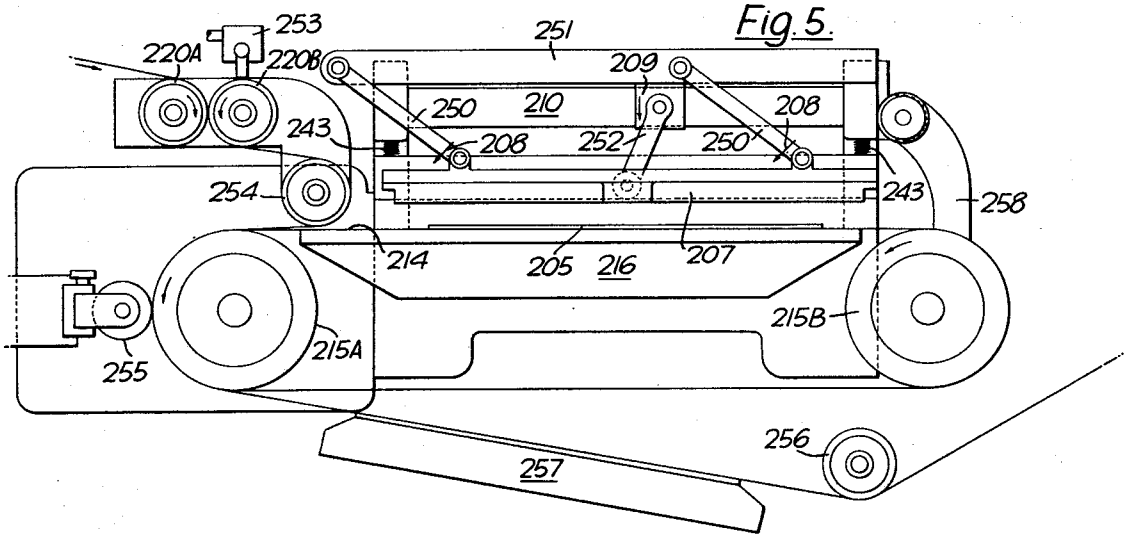
FIG. 5 is a front view of the tear-strip applier.

From the pulley 106 of the splicer (FIGS. 2 to 4) the wrapping web passes to mechanism for producing tear-strips and for applying the tear-strips to the web, shown in FIG. 5. This mechanism is in substance disclosed in FIGS. 4 to 6 of British patent specification No. 1,132,201 and will therefore only be described briefly, using where appropriate the same reference numerals as those in that specification.

A continuous web, (not shown) whose width corresponds to the desired length of the tear-strip to be produced, is fed intermittently at increments of about 3 mm from the back of the mechanism (i.e. in a direction normal to the plane of FIG. 5 hereof) between a fixed knife 205 and a movable knife 207. A pair of springs 243 urge together a pair of drive rollers (not shown), between which rollers the continuous web is fed to the knives. The knife 207 is swingingly mounted on two inclined parallel links 250 to a fixed structure 251. An arm 209, which is secured to a drive shaft 210 at the back of the mechanism, carries at its free end a tie rod 252 whose length is adjustable. The tie rod is connected to the knife 207 so that as the arm 209 is pivoted downwards the cutting edge of the knife swings arcuately, initially in the direction indicated by the arrows 208, to a position below the edge of the fixed knife 205.

As described in the above British patent specification No. 1,132,201 the movable knife 207 is slightly inclined to the fixed knife 205 so that it progressively cuts a tear strip and deposits it on to a suction belt conveyor 214 whose width is slightly greater than the 3 mm width of the tear-strip. The conveyor 214 is carried by a wide drive roller 215 and by a narrow idler roller 215, and its upper run is provided with a suction box 216. The tension in the conveyor 214 may be varied by adjusting the angular position of an arm 258 about whose movable end the roller 215B is rotatably mounted.

The wrapper web enters the mechanism between a pair of rollers 220A and 220B. Mounted closely above the roller 220B is a solvent applier 253 which feeds a narrow film of solvent on to the roller 220B for transfer to that central part of the web to which the tear-strip is to be applied. The web then passes over a roller 254 and comes into contact with the conveyor 214 and thus also into contact with the succession of tear-strips. A rubber compression roller 255 bears against the drive roller 215A to press the web against the tear-strips and to ensure that the web does not slip relative to the drive roller 215A. The web and tear-strips then pass away from conveyor 214 and drive roller 215 to a further roller 256 between which rollers is positioned a retractable heater 257, which dries the solvent and so bonds the tear-strips to the web to produce a composite web.

Splice Detector and Cutter Unit

Figure 6:
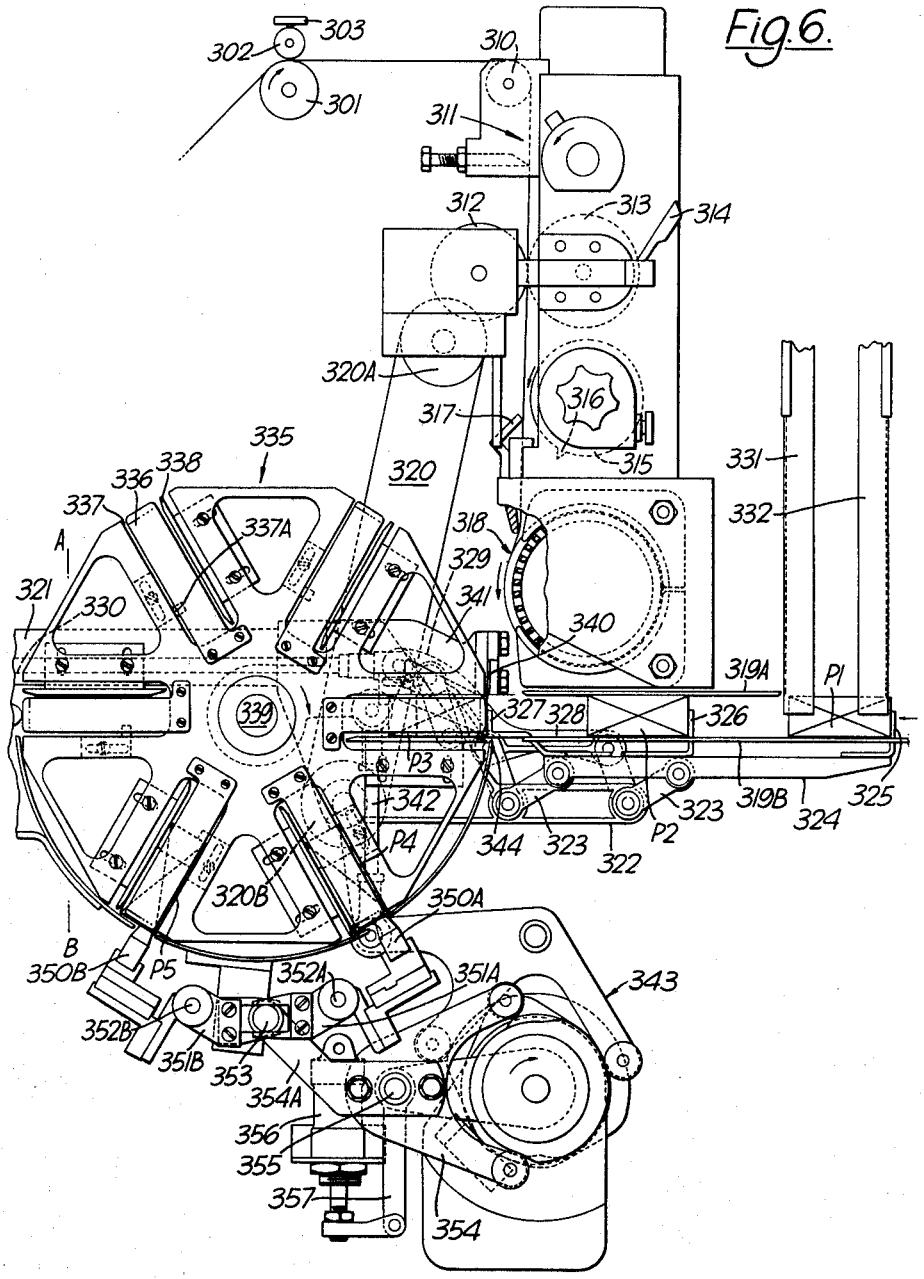
FIG. 6 is a front view of the initial wrapping mechanism.

Referring next to FIG. 6, after leaving the tear-strip applier the web passes through a splice detector consisting of a roller 301 whose axis of rotation is fixed and around which the web passes, and a roller 302 which is movable away from the roller 301 against a light spring bias, and which is normally spaced apart from the roller 301 by a distance slightly greater than the thickness of the web. A microswitch 303 is in contact with the roller 302 on the side remote from the roller 301.

When the indentation in the spliced portion of the web formed by the depression 117 and projection 116 (FIG. 2) passes between the rollers 301 and 302, the roller 302 begins to rotate and move away from the roller 301, operating the switch 303 and thus passing a signal to the rejection unit, as mentioned above.

The web then passes over a roller 310 and to a small rotary cutter, shown generally by the reference numeral 311. This produces a regular succession of U-shaped cuts in the web.

Below the cutter 311 are a pair of rollers, consisting of a rubber idler roller 312 and drive roller 313. The idler roller 312 can be swung away from the drive roller 313 (for example when the web is to be threaded therethrough) by means of a latch 314.

The web, which is fed downwards by the roller 312 and 313, is next cut transversely into wrapper lengths by a cutter drum 315 having a cutting blade 316 cooperating with a stationary cutting member 317. Transverse cuts are made from the ends of each U-shaped cut, so that a tear tab is formed at the leading end of each wrapper. When the wrapper has been wrapped around a packet, the tear tab projects from the wrapper, allowing it to be gripped to tear open the wrapper.

The wrapper is then passed down on to a suction drum 318.

Clutch

The cutters 311 and 315, the drum 318 and the drive roller 313, as well as the drive roller 215A for the tear-strip, are all driven from a cyclic gearbox (not shown) of the known type having an eccentric gear. The drive from the gearbox is transmitted through a clutch which is disengageable and re-engageable at that point in the cycle at which the drive speed is at a minimum.

Figure 6A:
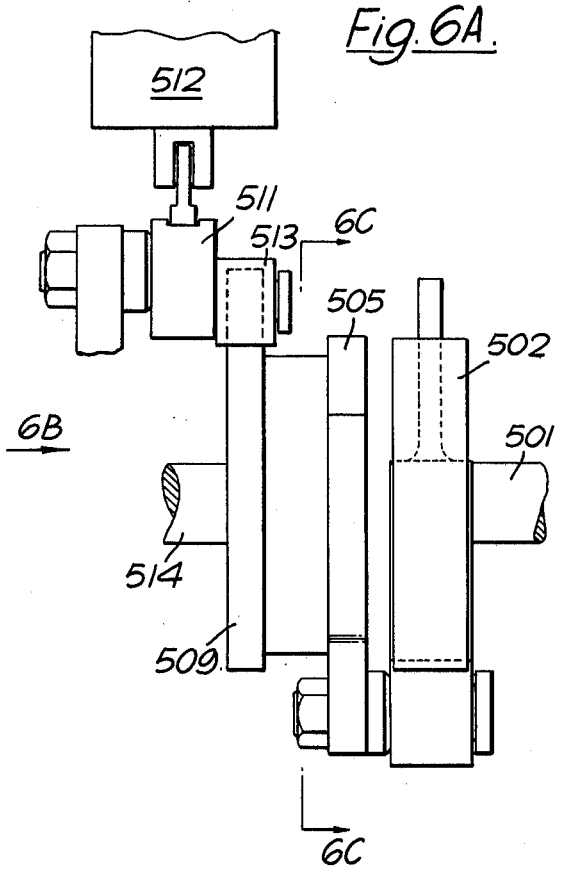
FIG. 6A is a side elevation of a clutch to drive the mechanism of FIG. 6.
Figure 6B:
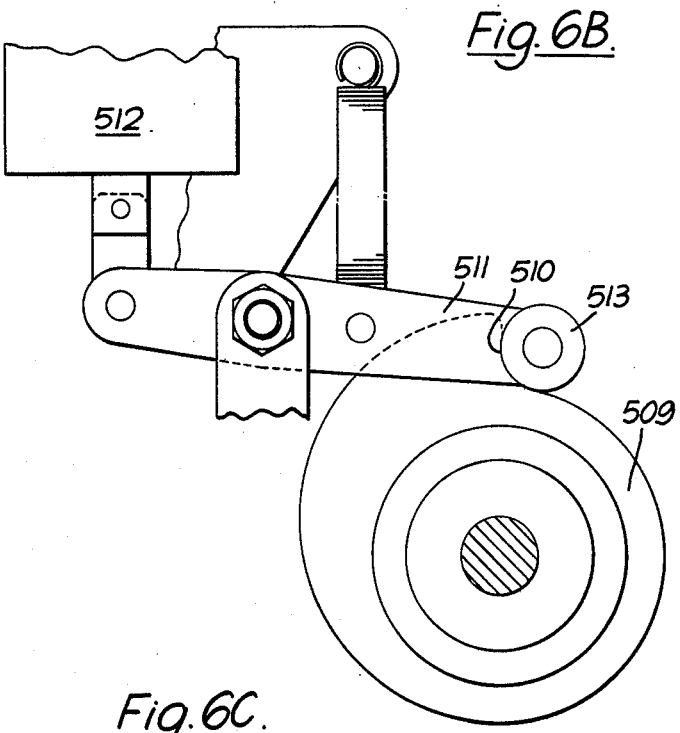
FIG. 6B is an end elevation of the clutch of FIG. 6A, as viewed in the direction of arrow 6B.
Figure 6C:
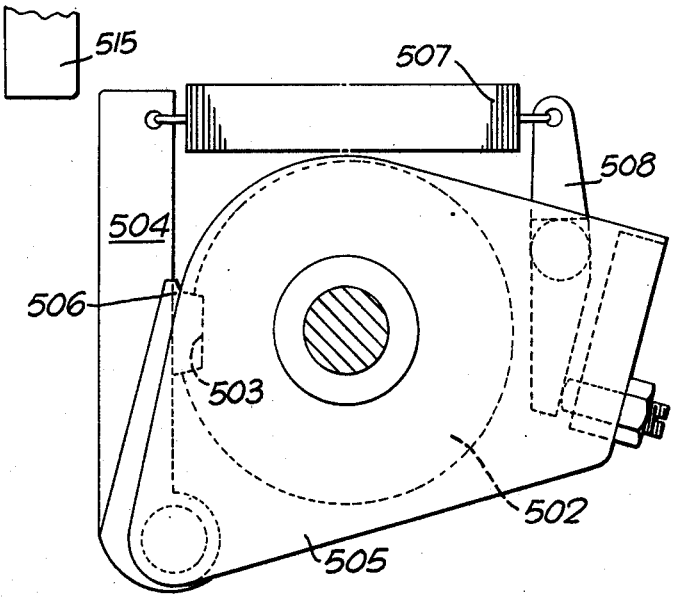
FIG. 6C is a section view taken on the line 6C—6C of FIG. 6A.

The preferred form of clutch presently used for this purpose is illustrated in FIGS. 6A, 6B and 6C. The gearbox drives a shaft 501 to which is secured a driving wheel 502 having formed in its periphery a transverse tapered recess 503 (see FIG. 6C). A pawl 504 pivotable about a rotatable plate member 505 has a correspondingly tapered tooth 506 for engagement in the slot. The pawl is biassed into the slot by a spring 507, whose tension can be varied by a lever 508 adjustably mounted on the plate member 505.

Secured axially to the plate member 505 is a snail-shaped wheel 509 rotatable clockwise, as viewed in FIG. 6B, and having a radial abutment 510. A lever 511 pivotable about fixed structure is connected at one end to a solenoid 512, and carries at its other end a roller 513 which is engageable with the abutment 510. Connected to the left of the wheel 509 is an output shaft 514 to drive the various cutters and rollers mentioned above.

The solenoid 512 is energisable by the splicing switch 115, i.e. when a splice is to be made; and also by detector devices (not shown) which become operable when no packets are fed to the wrapping machine. Energising of the solenoid brings the roller 513 against the snail wheel 509, and as it reaches its minimum speed the roller drops against the abutment 510, as shown in FIG. 6B. The resulting sudden loading on the wheel 509 produces an increase in torque at the member 505 which forces the tooth 506 to be cammed out of the tapered slot 503 against the tension of the spring 507. It will be observed that the line of contact between the lower face of the tooth and the corresponding surface of the slot 503, is inclined to the effective line of forces between said lower face and the pivotal axis of the pawl, so as to allow this camming action. The free upper end of the pawl 504 is then brought to bear against a fixed projection 515, as the wheel 502 continues to rotate with the tooth 506 rubbing against its periphery. After one or more revolutions of the wheel 502 the solenoid 512 is de-energised (e.g. at the end of a splicing operation) and the roller 513 lifted away from the abutment 510. As soon as the recess 503 in the driving wheel 502 reaches the position shown in FIG. 6C, i.e. at its minimum speed, the tooth 506 drops into the recess 503, causing the member 505 and hence the output shaft 514 to be driven again from the gearbox.

If the clutch is only to be disengaged for one revolution of the driving wheel 502 (e.g. when a single packet is missing at that position of the wrapping machine at which a packet is plunged into a wrapper, as will be described below) the solenoid 512 may be de-energised as soon as the pawl tooth 506 is cammed out of the recess 503 in the wheel 502. To this end a stop member 515 prevents further rotation of the pawl 504, and hence of the output shaft 509, until the tooth 506 re-engages the recess 503. For more than one disengaged revolutions of the wheel 502, the stop member 515 likewise enables the solenoid to be energised only each time the slot 503 passes the tooth 506, rather than being continuously energised.

To ensure a positive movement of the roller 513 into and out of engagement with the abutment 510, a double-acting air cylinder may be used in place of the solenoid 513.

In the arrangement shown in FIG. 6 the cutters 311 and 315, the roller 313, and the drum 318 all rotate in unison, being all geared together in 1:1 ratio. If a wrapper of different length is desired, the gearing to the drive roller 313 and drum 318 (relative to the cutters 311 and 315) can be changed appropriately.

Since the diameter of the drum 318 is greater than that of the roller 313, its peripheral speed is proportionately greater at any point in the cycle. Thus a wrapper before being cut slides relative to the periphery of the suction drum 318, and after being cut the wrapper increases its spacing from the next wrapper to be cut.

Initial Wrapping

The wrapper is fed further downwards by the drum 318, crossing a horizontal packet track, defined by an upper guide 319A and a lower guide 319B, along which cigarette packets are fed in timed relation with the cyclic feed imparted to the wrapper. The arrangement is so chosen that the downward speed of the wrapper (as fed by the drum 318) is approximately at a minimum at the point at which a cigarette packet, shown at a position P2, is plunged into the wrapper. This arrangement allows a very accurate positioning of the middle of a wrapper across the track as a packet at P2 is thus plunged.

The mechanism of feeding packets along the track will next be described.

Figure 7:
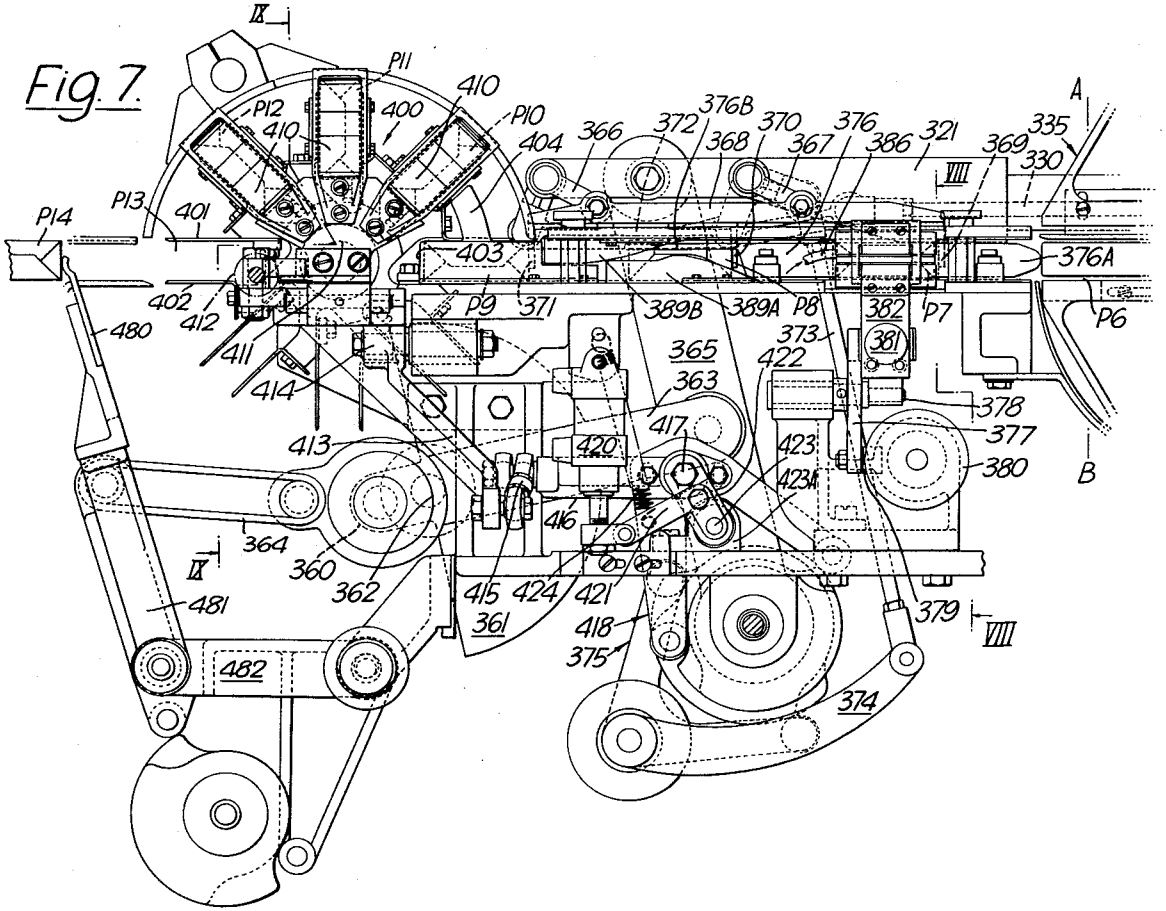
FIG. 7 is a continuation of FIG. 6 from line AB, showing the final wrapping mechanism.

A slave link 320, pivoted about its upper end 320A, is driven at its lower end 320B by a horizontal beam 321, to which a reciprocating motion is imparted by a mechanism to be described below with reference to FIG. 7.

A small beam 322, integral with beam 321, extends to the right of the lower end 320B of the slave link. Pivotally mounted on the beam 322 are two bell-cranks 323 to the ends of whose right-hand arms is pivotally mounted a horizontal pusher beam 324. The beam 324 carries fixed pushers 325, 326 and 327 which, in the position shown, engage respectively with packets at positions P1, P2 and P3. The right-hand parts of the two bell-cranks 323 and the portions of the beams 322 and 324 connected thereto, thus together form a parallelogram linkage.

The left-hand ends of the bell-cranks 323 are pivotally linked to a member 328. An extension 329 to the left of the member 328 is pivotally connected to a horizontal rod 330, which is reciprocated by cam mechanism also to be described below with reference to FIG. 7.

The combined effect of the movements of the beam 321 and of the rod 330 is such that the beam 324, and the pushers 325 to 327 thereon, move in an approximately rectangular path: i.e. moving approximately horizontally to the left along the packet track, descending vertically out of the way of the packets, moving approximately horizontally to the right by a distance slightly greater than the pitch between adjacent pushers, and finally ascending vertically so that a pusher can engage behind the next packet.

The packets are fed to the guides 319A and 319B of the track from an adjoining packing machine, such as described in our co-pending British patent application No. 7858/73 (German application No. P 24 07 311.8). However, if it is desired to operate the wrapping machine without the packing machine, for example when a batch of faultily wrapped packets has to be rewrapped, such packets may be fed down on to the lower guide 319B of the packet track from a vertical stack, defined by side guides 331 and 332, into which packets may be stacked by hand.

Immediately to the left of the third pusher 327 is a rotor 335 having 6 equispaced pockets, each adapted to receive a packet. The sides of each pocket are defined by front and rear springs 336 (each rear spring being hidden by the front spring), by a fixed face 337 and by adjustable front and rear spring plates 338. The plates 338 are spaced apart by a distance sufficient for a pusher member, to be described below, to pass therebetween. A stop 337A is mounted adjustably along the middle of the face 337 to limit insertion of a packet in a pocket. It should be noted that in FIG. 6 references have only been applied to the pocket at the 11 o'clock position, in order to avoid unnecessary duplication.

The rotor 335 is rotatably mounted about a horizontal axis 339 for indexing clockwise in steps of 60°, corresponding to the spacing between adjoining pockets, by a Geneva type mechanism (not shown) driven in timed relation with the output from the cyclic gearbox above mentioned. The rotor and pockets are so arranged that when a pocket is at rest the end of the packet track, the sides of the pocket are aligned with the track.

When the middle of a wrapper has reached the centre of the packet track, the pusher 327 plunges the packet into the wrapper and thus into a pocket of the rotor 335. As the sides of the wrapper at the leading face of the packet meet the curved ends of the front and rear springs 336, they are tucked down against the corresponding sides of the packet, in the manner shown diagrammatically in FIG. 10 at P3.

Figure 10:
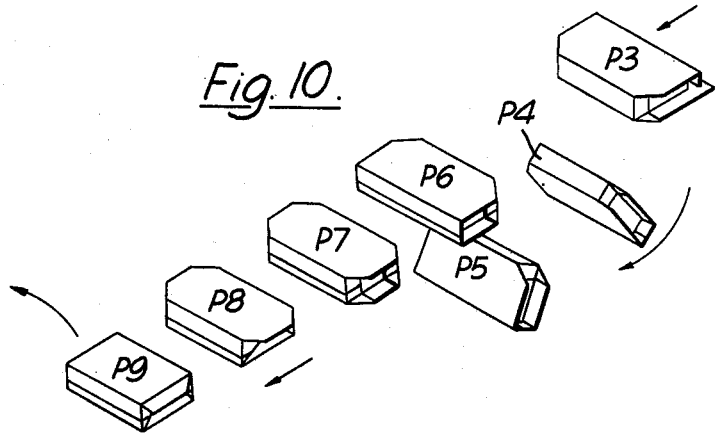
FIG. 10 is a perspective view of packets at the various wrapping positions shown in FIGS. 7 to 9.

A folder 340 now descends to fold down the top trailing flap of the wrapper against the right-hand face of the packet at P3, again as shown in FIG. 10. The folder 340 is secured to a member 341 which is mounted for pivotal movement about the rotor axis 339. The member 341 is pivoted by a vertically disposed rod 342 actuated by a conjugate cam assembly shown generally at 343.

The rotor is next indexed 60° to bring the pocket to the position P4. In being so indexed, the bottom flap of the wrapper meets a stationary folder 344, secured adjacent to the periphery of the rotor 335, which folds the bottom flap up against the previously folded top flap.

At packet positions P4 and P5 the resulting overlap in the flaps is sealed by a pair of heating irons 350A and 350B respectively. The heating irons are secured to the outer ends of arms 351A and 351B which are respectively pivoted about fixed axes 352A and 352B. The inner ends of the arms are forked, and engaged with a cylindrical member 353. The member 353 is mounted at the end of a lever 354A forming part of a conjugate cam follower assembly 354, which is pivotable about a shaft 355. The cams which actuate the lever 354 are mounted co-axially with the cams of the conjugate cam assembly 343.

Pivotal movement of the lever 354 causes the cylindrical member 353 to move substantially vertically, bringing the irons 350A and 350B towards and, after a period of time, away from the packets at each of positions P4 and P5. In the event that the wrapping machine is stopped with the irons in contact with the packet, the irons are automatically retracted from the packets by the retraction of a ram 356, which acts through a link 357 to swing the shaft 355 upwards about the centre of the conjugate cams.

Final Wrapping

The mechanism for reciprocating the beam 321 and the rod 330 will now be described with reference to FIG. 7. A crank 360, incorporating a large counterweight 361, is rotatable by a horizontal shaft 362. The crank drives both a connecting rod 363 and a drive link 364, whose function will be described below. The end of the rod 363 remote from the crank 360 is pivotally connected to approximately the middle of a master link 365, which is of the same length as the slave link 320 described earlier. The top end of the link 365 is pivotally connected to the beam 321 near its left-hand end, while the bottom end of the link 365 is pivotally mounted to fixed structure. The oscillating motion imparted by crank 360 to the link 365 results in the beam 321 oscillating in an arc, but in a substantially horizontal attitude.

Mounted pivotally on the beam 321 to the left and right of the top end of the link 365 are two bell-cranks 366 and 367 respectively, which are similar to the bell-cranks 323 described above. The left-hand arms of the bell-cranks 366 and 367 pivotally carry a pusher beam 368 to which three downwardly facing pushers 369, 370 and 371 are secured. The right-hand arms of the bell-cranks are pivotally connected by a member 372, which is also pivotally connected to the left-hand end of the rod 330.

The bell-crank 367 is actuated by a rod 373 from an arcuate lever 374 which is secured to a follower assembly operable by a conjugate cam, indicated generally at 375. The conjugate cam 375 is so shaped that, in combination with the oscillating motion of the beam 321, it moves the pushers 335 to 337 in a substantially rectangular path, similar to that described above in relation to the pushers 325 to 327. In other words, the beam 321 produces the basic horizontal motion of the pushers, while the conjugate cam 375 moves the pushers up or down at the ends of their horizontal movement, and also compensates for the vertical component of movement caused by the arcuate movement of the beam 321.

When the rotor 335 is indexed to bring a packet to position P6, the pusher 369 enters between the front and rear plates 338 of the respective pocket and withdraws the packet from the rotor. As the packet is withdrawn a pair of stationary tuckers 376A meet the leading overlapped margins at the front and rear of the wrapper, to tuck them against the sides of the packet as shown at P7 in FIG. 10.

Figure 8:
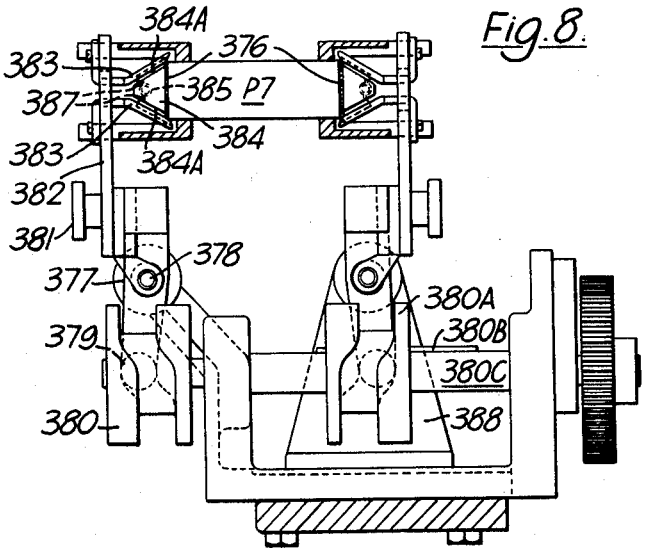
FIGS. 8 and 9 are sectional views taken on the lines VIII—VIII and IX—IX respectively of FIG. 7, but drawn to a larger scale.

When a packet has been brought by the pusher 369 to position P7, a solvent solution is applied to the four wrapper ears which project from the front and rear sides of the packet. The device for applying the solvent will now be described, referring additionally to the sectional view of FIG. 8. (It should be noted that this device would be omitted on wrapping machines using wrapper webs made from polypropylene, and other heat-sealing materials). As most of the parts of the assemblage to the left of FIG. 8 are similar to those to the right, the latter assemblage will not be described except where there are differences.

An arm 377 pivotally carried on a spindle 378 carries at its lower end a cam follower 379, which is in engagement with a box cam 380 driven by a cam shaft 380C. Detachably secured to the top of the arm 377 by a screw 381 is an arm extension 382 carrying upper and lower divergent fingers 383 which, when the box cam is in the position P7 shown in FIG. 8, engage the wrapper ears projecting from the packet.

A stationary member 384 is secured against a strip 376 which is integral with the tucker 376A and which extends along the sides of the packets track. The member 384 carries upper and lower solvent wicks 384A which are shaped in a pattern to correspond with the area along which it is desired to seal down the ears of the wrapper. The wicks 384A and the adjacent surfaces of the member 384 are disposed parallel to the respective fingers 383. A longitudinal bore 385 formed in the member 384 connects a solvent feed pipe 386 (FIG. 7) with the wicks 384A along upper and lower drilled passages 387.

In order for the solvent applicator device to be capable of operating on packets having widths (as viewed in the plane of FIG. 8) different from that shown, an adjustable rear mounting 388 is provided to allow the entire rear assemblage to be moved to the left or right of the position shown. Corresponding adjustment of the rear box cam 380A is provided by a key 380A in the cam shaft 380C, which permits the cam 380A to be secured at the desired axial position.

In operation a packet is brought to position P7 while the box cam 380 is at a position where the arm extension 382 is retracted. As the packet comes to rest at P7 the projecting ears of the wrapper thus gently glide along the inside surfaces of the fingers 383, becoming partly folded inward towards one another. Rotation of the cam 380 brings the fingers 383 towards the packet, pressing the ears against the wicks 384A, which thus imprint a pattern of solvent on the inside surfaces of the ears. Further rotation of the cam 380 retracts the fingers 383 from the ears in readiness for the packet to be moved towards position P8 by the pusher 370. The cam cycle is then repeated for the next packet.

On leaving position P7 each lower ear of the wrapper encounters nylon ploughs 389A (FIG. 7) which fold the lower ear against the respective side of the packet, as shown in FIG. 10. Between positions P8 and P9 are located further nylon ploughs 389B, which similarly fold down each upper ear to overlap the lower one. The strips 376 are cut away around the area of the first ploughs 389A, leaving the left-hand end of the strip 376 narrowed, as shown at 376B.

To the left of the ploughs 389B is a sealing drum 400 having 8 equi-spaced pockets. The drum is indexable anti-clockwise in steps corresponding to the spacing between the pockets, packets being held in the pockets between spring plates 401 and 402 (referenced in FIG. 7 only at the 9 o'clock position of the drum).

Figure 9:
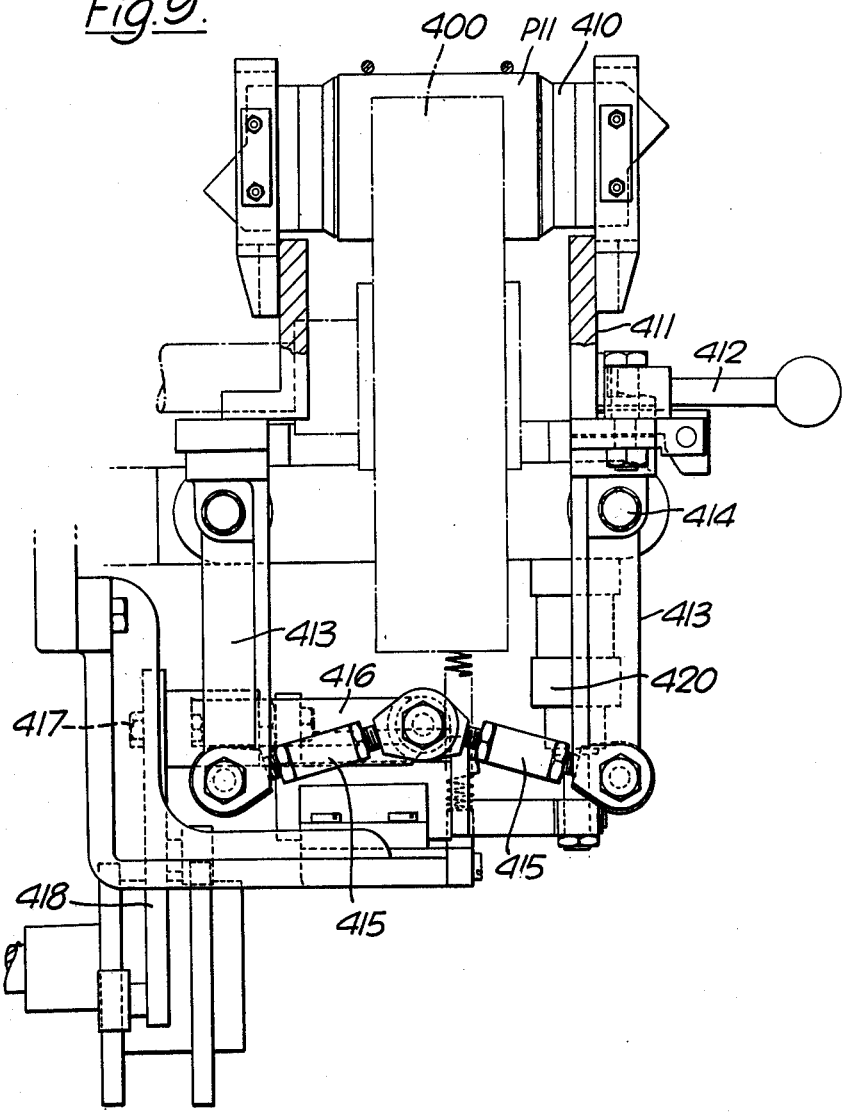

On leaving the ploughs 389A and 389B and entering the pockets at position P9, the folded ears of the packet wrapper come under the control of front and rear fixed strips 403 (the rear strip being hidden). Each strip 403 is, in effect, an interrupted continuation of the respective strip 376. An upward extension 404 on each strip 403 further ensures that the wrapper ears are kept folded down while the rotor indexes the packet to a position P10, where the ears are sealed down by a heater device to be described below, with reference additionally to FIG. 9.

A heating iron 410 is provided at the front of the rotor 400 (i.e. to the right, as viewed in FIG. 9) at each of positions P10 to P12, the 3 arms being mounted on a member 411 which can be manually released by a clamping handle 412. With the handle 412 in the clamped position the member 411 is fast with a lever 413 pivotal about a horizontal shaft 414. A similar arrangement is provided at the rear of the rotor 400, except that no clamping handle is provided there.

The front and rear levers 413 are actuated by a toggle linkage, consisting of front and rear links 415 which are inclined upwards towards one another and have spherical end couplings. The links 415 connect the lower ends of the respective levers 413 to an arm 416 which is pivotal about an axis 417 and forms part of a follower assembly 418 of a conjugate cam.

Anti-clockwise movement of the follower assembly 418 about the axis 417 causes the inner ends of the links 415 to move downwards. Because of the upwards inclination of the links, the lower ends of the levers 413 are moved apart, bringing the heating irons 410 against the sides of the packet, as shown in FIG. 7, and then drying the solvent to seal the wrapper ears together. After a desired period of time, determined by the dwell period of the cam, the heating irons 410 are withdrawn and the packet is indexed to position P11. The heat-sealing operation is repeated twice more by the irons 410 at positions P11 and P12 in order to ensure complete sealing of the wrapper ears.

As in the case of the previous irons 350A and 350B, in the event that the wrapping machine is stopped with the irons 410 in their operative position, the irons 410 are moved outwards, in a direction away from their operative position, by a ram 420 pivotally connected to a lever 421. The lever 421 is secured to a link 422 which pivotally connects the shaft 417 to a pin 423 in a fixed lug 423A. When the ram 420 is retracted, assisted by a tension spring 424 connecting the lever 421 to fixed structure, the lever 421 rotates the link 422 and hence moves the shaft 417 to displace the cam follower assembly 418. Arm 416 is therefore lifted, resulting in the irons 410 moving outwards away from the wrapped packets.

When a packet is indexed to position P13 a forked pusher 480 enters under the lower spring plate 402, straddles the plate, and slides the packet out of the pocket to the final position P14. The pusher 480 is mounted on an arm 481 which is pivotally held by the drive link 364, mentioned earlier, and by one end of a follower 482 of a conjugate cam. Oscillating motion of the drive link 364 (derived from crank 360) combined with movement derived from the cam follower 482, results in the pusher 480 moving in a substantially rectangular path, similar to that described for the pushers 369 to 371.

The packet at P14 may be fed to a boxing machine for enclosing several packets (for example ten packets) in a box. Preferably a rejection unit is arranged at position P14, so that if a packet is faultily wrapped, for example as signalled by the splice detector above mentioned, it may be rejected at this position.

We claim:

1. Apparatus for wrapping articles, such as cigarette packets, comprising means for cutting a web of wrapping material to form individual wrappers, means for feeding the wrappers successively towards articles to be wrapped, drive means to drive the cutting and feeding means at a cyclically varying speed which cyclically decreases to a minimum speed, and clutch means to disengage the drive means when no wrappers are to be fed, said clutch means being disengageable and re-engageable at the minimum speed of the drive means.

2. Apparatus as claimed in claim 1 in which the drive means includes a cyclic gearbox of the type having an eccentric gear.

3. Apparatus as claimed in claim 1 in which the clutch means comprises a driving member connected to the cyclic drive means, a driven member, a driving surface on one of the members, a pawl pivotally mounted on the other member and biased to engage the driving surface, and means to arrest the driven member at the angular position at which the driven member is rotating at minimum speed, the driving surface and the pawl being so shaped and disposed that the pawl is cammed away from the driving surface upon such arresting of the driven member.

4. Apparatus as claimed in claim 3 in which said driving surface has a recess in which the pawl is received so that the relative positions of the driving member and the driven member are always the same whenever the clutch means is engaged.

5. Apparatus as claimed in claim 3 in which the means to arrest the driven member comprises an abutment member secured to the driven member, and an element movable into the path of the abutment member to arrest the driven member.

6. Apparatus as claimed in claim 1 further comprising a splicing mechanism upstream of the cutting means to splice a new web to an exhausted web, said splicing mechanism being operably connected to said clutch means, so that the feed of the wrappers is interrupted during a splicing operation.

7. Apparatus as claimed in claim 6 in which said splicing mechanism comprises means to form an indentation in the portion of the web which is spliced, and a splice detector to detect said indentation and to produce a signal indicative of a faulty wrapper.

* * * * *